US009150374B2

(12) United States Patent
Ohmura

(10) Patent No.: US 9,150,374 B2
(45) Date of Patent: Oct. 6, 2015

(54) DANCER ROLLER APPARATUS

(71) Applicant: Yuuji Ohmura, Ibaraki (JP)

(72) Inventor: Yuuji Ohmura, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 213 days.

(21) Appl. No.: 13/865,498

(22) Filed: Apr. 18, 2013

(65) Prior Publication Data

US 2013/0277487 A1 Oct. 24, 2013

(30) Foreign Application Priority Data

Apr. 23, 2012 (JP) ..... 2012-097800

(51) Int. Cl.

| | |
|---|---|
| ***B65H 23/16*** | (2006.01) |
| ***B65H 23/188*** | (2006.01) |
| ***B65H 26/02*** | (2006.01) |
| ***B65H 20/34*** | (2006.01) |

(52) U.S. Cl.

CPC ..... *B65H 23/1888* (2013.01); *B65H 20/34* (2013.01); *B65H 26/025* (2013.01); *B65H 2403/72* (2013.01); *B65H 2408/2171* (2013.01); *B65H 2511/112* (2013.01); *B65H 2513/10* (2013.01); *B65H 2513/11* (2013.01); *B65H 2553/51* (2013.01); *B65H 2801/15* (2013.01)

(58) Field of Classification Search

USPC ..... 242/390.6, 390.9, 417.2, 418.1, 419.1, 242/419.9, 420.3, 420.4, 420.6, 421.5, 242/412.2, 413.3; 226/118.2, 118.3

See application file for complete search history.

(56) References Cited

U.S. PATENT DOCUMENTS

| | | | | |
|---|---|---|---|---|
| 4,223,822 | A * | 9/1980 | Clitheroe | 226/42 |
| 5,050,812 | A * | 9/1991 | Mueller | 242/418.1 |
| 6,050,517 | A | 4/2000 | Dobrescu et al. | |
| 6,267,283 | B1 | 7/2001 | Vogt | |

FOREIGN PATENT DOCUMENTS

| | | | |
|---|---|---|---|
| DE | 1 916 892 | A1 | 12/1970 |
| EP | 0 989 084 | A2 | 3/2000 |
| JP | 03-050128 | Y2 | 10/1991 |
| JP | 2002-029652 | | 1/2002 |
| JP | 2007-230719 | | 9/2007 |
| JP | 2009-073587 | A | 4/2009 |

OTHER PUBLICATIONS

Extended European Search Report issued Apr. 8, 2014 in Patent Application No. 13164152.4.

* cited by examiner

*Primary Examiner* — Sang Kim

(74) *Attorney, Agent, or Firm* — Oblon, McClelland, Maier & Neustadt, L.L.P.

(57) ABSTRACT

A dancer roller apparatus is disclosed. The apparatus includes a dancer roller; a drive motor; and a dancer roller position changing unit, wherein the dancer roller position changing unit is provided with a one way clutch which allows the dancer roller to move in a long object slack direction, and wherein the drive motor is caused to rotate in a direction such that the dancer roller moves the one way clutch in a long object stretching direction during conveying of a long object.

8 Claims, 11 Drawing Sheets

DANCER ROLLER APPARATUS

TECHNICAL FIELD

The present invention generally relates to a dancer roller apparatus including a dancer roller arranged between a long object conveying unit on the upstream side and a long object conveying unit on the downstream side that is for absorbing an amount of slack of a long object such as a web, for example, and specifically relates to a dancer roller apparatus including a path length switching unit which switches between long object path lengths during conveying of the long object and at the time of loading the long object.

BACKGROUND ART

In an image forming system which includes a printing apparatus which forms an image onto a continuous web; and a web treatment apparatus which applies a specified treatment onto the web before or after printing, or a pre-treatment and post-treatment apparatus which reels out or reels in a roll-shaped web, there often exists multiple web conveying units on a web conveying path within the system. In this case, in general, a dancer roller apparatus is arranged so that an amount of slack of the web between a web conveying unit on the upstream side and a web conveying unit on the downstream side is absorbed and a proper tension is applied onto a web to be conveyed.

FIG. 7 is an overview configuration diagram showing one example of a flow of an inkjet image forming system.

In the system as shown, a web W, which is sent out from a paper-feeding apparatus 100, is sent into a treatment agent applying apparatus 101 and has applied onto an image forming face thereof a treatment agent which includes a function of coagulating ink before ink droplets impact on the web in order to solve problems such as blur, density, color tone, offset, etc. Depending on a desired printed matter, a face onto which a treatment agent is to be applied may be a single face or a double face.

Next, the web W is sent into a first inkjet printer 102, which ejects ink droplets on the front side of the web W, so that a desired image is formed thereon. Then, a front and a back of the web W are reversed by a turnover apparatus (not shown), and the web W is continuously sent into the second inkjet printer (not shown), ink droplets are ejected onto the back side of the web W, so that a desired image is formed. Then, the system is arranged such it is sent to a post-treatment apparatus in which a predetermined post-treatment is performed thereon.

FIG. 8, which is a schematic configuration diagram showing one example of the treatment agent applying apparatus 101 which is used in this image forming system, shows a state at the time the treatment agent is applied.

As shown, a large number of guide rollers 1, each having a bearing (not shown) at both ends thereof to be rotatably supported thereby, are arranged within the treatment agent applying apparatus 101 to secure a conveying path of the web W. A lead-in roller 2 is rotationally driven by a driving source (not shown) such as a motor and a nip roller 3 is pushed to the lead-in roller 2 side due to a pull tension of a spring (not shown). The lead-in roller 2 and the nip roller 3 may be rotated to lead in the web W from the paper-feeding apparatus 100 to inside this treatment agent applying apparatus 101.

Moreover, the web W which is sent out of the lead-in roller 2 and the nip roller 3 forms an air loop 4 with some slack, an amount of which slack within the air loop 4 is monitored by slack amount detecting units 36*a*-36*d*, which include optical sensors arranged in multiple steps, and the lead-in roller 2 is driven and controlled such that the amount of slack becomes constant.

The web W which has passed through the air loop 4 passes between a path shaft 5 and an edge guide 6. Two path shafts 5 are arranged in a direction which is orthogonal to a conveying direction of the web W, which passes between the path shafts 5 in an S shape. A pair of edge guides 6 is supported by the path shafts 5 and a dimension of a gap between the edge guides 6 is set generally the same as a width dimension of the web W. Therefore, a running position of the web W in a width direction can be regulated.

The edge guide 6 is fixed to the path shaft 5 with a screw, for example, so that a position thereof can be adjusted in accordance with a width dimension of the web W used.

Prior to a stage in which the web W, which has passed between the path shafts 5 and the edge guides 6, is sent into a feed nip roller 9 which is pressed against by an in feed roller 8 and a spring (not shown), a moderate tension is applied thereto in order to suppress folding or crawling. In the example shown, winding friction is added to a tension shaft 7. The infeed roller 8 is rotationally driven by a driving source (not shown) such as a motor, etc., and conveys the web in cooperation with the feed nip roller 9.

The web W which has passed through the infeed roller 8 is wound around in a U shape from the bottom side of a single first dancer roller 10, which is rotatable. The first dancer roller 10 is rotatably mounted on a first movable frame 11 via a bearing (not shown) which is provided at a roller end portion. Therefore, an encompassing first dancer roller mechanism 12 is hung by the web W.

This first dancer roller mechanism 12 can be moved along gravity directions (upward and downward directions) A. Also are provided first dancer roller mechanism position detecting units 37*a* to 37*d* which detect a position of the first dancer roller mechanism 12; in accordance with an output of the position detecting units 37*a* to 37*d*, a driving source of the infeed roller 8 may be controlled to increase or decrease speed to regulate a position of the first dancer roller mechanism 12.

The web W, which has passed through the first dancer roller mechanism 12, successively passes through a front face applying unit 13*f* which applies on the front face side thereof a treatment agent and a back face applying unit 13*r* which applies on the back face thereof the treatment agent, so that the treatment agent is applied on both faces of the web W. The treatment agent applying unit 13 is not substantially relevant to the present invention, so that an explanation thereof is omitted.

The web W which has passed through the back face applying unit 13*r* passes through an out feed roller 14 which is rotationally driven by a driving source (not shown) such as a motor, etc., and another feed nip roller 9 which is pushed to the outfeed roller 14 side by a spring (not shown). The outfeed roller 14 is rotationally driven by a driving source (not shown) such as a motor, etc., and conveys the web W in cooperation with the other feed nip roller 9.

Next, the web W is wound, in a W shape, around two second dancer rollers 15*a* and 15*b*, which are rotatable, and a guide roller 1 which is arranged between the dancer rollers 15*a* and 15*b*. The two dancer rollers 15*a* and 15*b* are rotatably mounted to a second movable frame 16 via a bearing (not shown) which is provided to a roller end portion to configure a second dancer roller mechanism 17. Therefore, this second dancer roller mechanism 17 is hung by the web W.

This second dancer roller mechanism 17 is also movable along gravity directions (upward and downward directions) A, and also provided are multiple-step second dancer roller mechanism position detecting units 38*a*-38*d*, which detect a position of the second dancer roller mechanism 17, so that a driving source of the out feed roller 14 may be controlled to increase or decrease speed in accordance with an output of the position detecting units 38*a* to 38*d* to regulate a position of the second dancer roller mechanism 17.

In this way, the web W, which has passed within the treatment agent applying apparatus 101, is sent into the first inkjet printer 102 on the downstream side as shown in FIG. 7.

Here, with respect to the in feed roller 8 and the out feed roller 14, it is difficult to cause the web conveying speeds thereof to completely match due to a rotational speed error, etc., of a driving source (not shown) or a machining error of a roller diameter. Therefore, a difference of the web conveying speeds can be absorbed by a buffer function of the first dancer roller mechanism 12 to perform continuous conveying.

In other words, if a rise in a position of the first dancer roller mechanism 12 is detected, driving and control are performed such that a rotational speed of the in feed roller 8 which is positioned on the upstream thereof is increased to lower the position of the first dancer roller mechanism 12. Conversely, if a drop in a position of the first dancer roller mechanism 12 is detected, driving and control are performed such that a rotational speed of the in feed roller 8 is decreased to raise the position of the first dancer roller mechanism 12.

Similarly, the second dancer roller mechanism 17 also absorbs a difference in a web conveying speed between a conveying roller (not shown) which determines a web sending-in speed within the first inkjet printer 102 and the outfeed roller 14.

Moreover, the first dancer roller mechanism 12 and the second dancer roller mechanism 17 apply tension to the web W with weights thereof, so that, for the first dancer roller mechanism 12, the tension which is applied to the web W is one half the mechanism weight since it is hung by the web W which is wound around in a U shape, while, for the second dancer roller mechanism 17, the tension which is applied to the web W is one fourth the mechanism weight since it is hung by the web W which is wound around in a W shape.

A related-art dancer roller mechanism has a buffer function, so that a path of the web W becomes complex as shown in the second dancer roller mechanism 17 in FIG. 8, etc.

Leaving the path complex causes loading of the web W to be difficult, so that there is commercialized an apparatus, wherein, at the time of loading the web, as shown in FIG. 9, the first dancer roller mechanism 12 and the second dancer roller mechanism 17 are raised and a length of a path which continues to the guide roller 1 is shortened to improve operability of web loading.

FIG. 10A is a schematic configuration diagram of a dancer roller apparatus as viewed from the front face; and FIG. 10B is a schematic configuration diagram for explaining a driving system of the dancer roller apparatus as viewed from the side face.

As shown in FIGS. 10A and 10B, two rail shafts 20 are arranged with a predetermined gap along gravity directions (upward and downward directions) A, between which two rail shafts 20 the second dancer roller mechanism 17 is arranged. As shown in FIG. 10A, on the side face of the movable frame 16 is fixed a multiple number (three in this example) of shaft guides 19, among which the rail shaft 20 is placed.

Moreover, the second movable frame 16 is connected to a timing belt 23 by a belt clamper 21. The timing belt 23 is stretched between timing pulleys 22*a* and 22*b* which are respectively placed thereabove and therebelow, while the timing pulleys 22*a* and 22*b* are respectively fixed with keys (not shown), etc., to both ends of elevating axles 24*a* and 24*b*.

The timing pulley 22*a* which is supported at one end of the elevating axle 24*a* is connected to a motor 30 via drive transmission gears 25 and 26; a drive axle 27; and drive gears 28 and 29. Therefore, this motor 30 may be rotationally driven to raise or lower the second dancer roller mechanism 17 along the rail shafts 20.

The above-described drive system becomes a load during conveying of the web, so that the dancer roller mechanism 17 affects an operation of absorbing a change in a path length of the web W. In other words, when the drive system becomes the load in the process of the dancer roller mechanism 17 being raised (the path being shortened), a tension applied to the web W increases by an amount corresponding to the load of the drive system in addition to a self weight of the dancer roller mechanism 17.

Conversely, when the drive system becomes the load in the process of the dancer roller mechanism 17 being lowered (the path being lengthened), an operation of the dancer roller mechanism 17 becomes slower, causing the web W to loosen as it cannot follow a change of the path, and causing the web W to become free (without tension).

In order to prevent this, an electromagnetic clutch 31 is provided within a drive transmission system. In an example in FIGS. 10A and 10B, the electromagnetic clutch 31 is arranged between the drive transmission gear 26 and the drive axle 27, and, therefore, when the electromagnetic clutch 31 is turned off during web conveying to separate an operation of the dancer roller mechanism 17 from the drive system, elevating of the dancer roller mechanism 17 causes the elevating axle 24 and the drive transmission gears 25 and 26 to rotationally operate, but the drive axle 27 does not rotate. When forced elevating of the dancer roller mechanism 17 is necessary, such as at the time of web loading, the electromagnetic clutch 31 is turned ON to connect the drive system and the dancer roller mechanism 17 and the motor 30 is rotationally driven to cause an elevating operation of the dancer roller mechanism 17.

A configuration, a control operation, etc., of the dancer roller apparatus are described in below-described Patent Documents 1 to 3, for example.

PATENT DOCUMENTS

Patent Document 1: Japanese Utility Model Application Publication No. 03-50128;

Patent Document 2: JP2007-230719A; and

Patent Document 3: JP2002-29652A

With a configuration as shown in FIGS. 10A and 10B, a problem such as the following arises:

During the web conveying, the dancer roller mechanism 17 is hung by the web W, so that, when the web W breaks due to jamming, etc., during the web conveying, the dancer roller mechanism 17 has undergoes a free fall. The dancer roller mechanism 17, which has undergone the fall, collides with a floor face (or a stopper) of the apparatus and is damaged, or the movable frame 16 is deformed, causing a degree of parallelization of the dancer rollers 15*a* and 15*b* to deviate.

When the dancer roller mechanism 17 breaks, the apparatus needs to be stopped due to component replacements, causing productivity to decrease. Moreover, when the degree of parallelization of the dancer rollers 15*a* and 15*b* deviates, stability of web conveying decreases, causing an irregularity in applying the treatment agent with the treatment agent applying apparatus 101. Furthermore, when a similar phenomenon occurs with the dancer roller mechanism which is used in a printing apparatus, printing quality decreases.

This dancer roller mechanism 17 provides a tension to the web W with a self weight, so that, when a web tension is set to 5 Kg, the self weight of the dancer roller mechanism 17 of 20 Kgf is needed, while it is necessary to increase a mechanism weight by an amount corresponding to the web tension. Therefore, when the web W breaks as described above, an impact of the dancer roller mechanism 17 colliding onto an apparatus floor face increases and seriousness of the problem also becomes salient. Here, while a configuration, etc., are explained taking the second dancer roller mechanism 17 as an example, the same also applies to the first dancer roller mechanism 12.

An apparatus including a mechanism which detects a breakage of the web W as described above is also being commercialized. FIG. 11 is a schematic configuration diagram of the treatment agent applying apparatus 101 including a mechanism which detects the breakage of the web W, while FIG. 12 is a schematic configuration diagram as viewed from a side face in order to describe a drive system of the dancer roller apparatus used in the treatment agent applying apparatus 101.

As shown in FIG. 11, a tension detecting unit 32 which detects the tension of the web W is arranged on a web conveying path. In an example in FIG. 11, a tension detecting unit 32*a* is provided on an outlet side of the first dancer roller mechanism 12, while a tension detecting unit 32*b* is provided on an inlet side of the second dancer roller mechanism 17. A detection signal from this tension detecting unit 32 (32*a*, 32*b*) is input into a fall prevention control unit 34 (see FIG. 12).

Moreover, as shown in FIG. 12, an electromagnetic brake 33 is attached to the other end of the elevating axle 24*a* in the dancer roller mechanism 17 and an ON/OFF control of the electromagnetic brake 33 is performed by the fall prevention control unit 34.

The mechanism is arranged such that, during the web conveying, the electromagnetic brake 33 is turned off so as not to affect an operation of the dancer roller mechanism 17, whereas, during the web conveying, when the web W breaks, a detected value of the tension detecting unit 32 (32*a*, 32*b*) generally becomes 0, so that the fall prevention control unit 34 turns on the electromagnetic brake 33 in accordance with this detected value to stop the fall of the dancer roller mechanism 17.

However, with this configuration, the tension detecting unit 32 (32*a*, 32*b*), the electromagnetic brake 33, the fall prevention control unit 34, etc., are added, so that a structure becomes complex, resulting in a high cost. Moreover, there is a problem such that, when either of the tension detecting unit 32 (32*a*, 32*b*) and the electromagnetic brake 33 fails, the fall of the dancer roller mechanism 17 may not be prevented.

DISCLOSURE OF THE INVENTION

An object of the present invention is to provide a dancer roller apparatus which does not undermine a dancer roller moving function for loading a long object; and a long object tension applying function and a buffer function during conveying of the long object such as a web, for example.

According to an embodiment of the present invention, a dancer roller apparatus is provided. The dancer roller apparatus includes a dancer roller which is arranged with a gap on a conveying path of a long object to convey the long object and is provided between a downstream side conveying unit and an upstream side conveying unit to absorb an amount of slack of the long object between the upstream side conveying unit and the downstream side conveying unit and provide tension to the long object; a drive motor for changing a position of the dancer roller during conveying of the long object and at a time of loading to switch a path length of the long object; and a dancer roller position changing unit which transmits a driving force from the drive motor to change the position of the dancer roller, wherein the dancer roller position changing unit is provided with a one way clutch which allows the dancer roller to move in a long object slack direction, and wherein the drive motor is caused to rotate in a direction such that the dancer roller moves the one way clutch in a long object stretching direction during the conveying of the long object.

The present invention makes it possible to provide a dancer roller apparatus which is configured as described above and which does not undermine a dancer roller elevating function for loading a long object; and a long object tension applying function and a buffer function during conveying of the long object.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Figure 7:
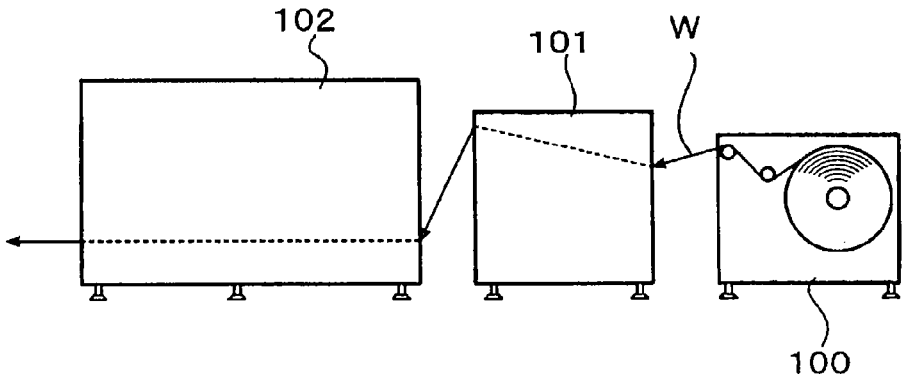
FIG. 7 Prior Art
FIG. 7 is a schematic configuration diagram showing one example of a flow of an inkjet image forming system.
Figure 8:
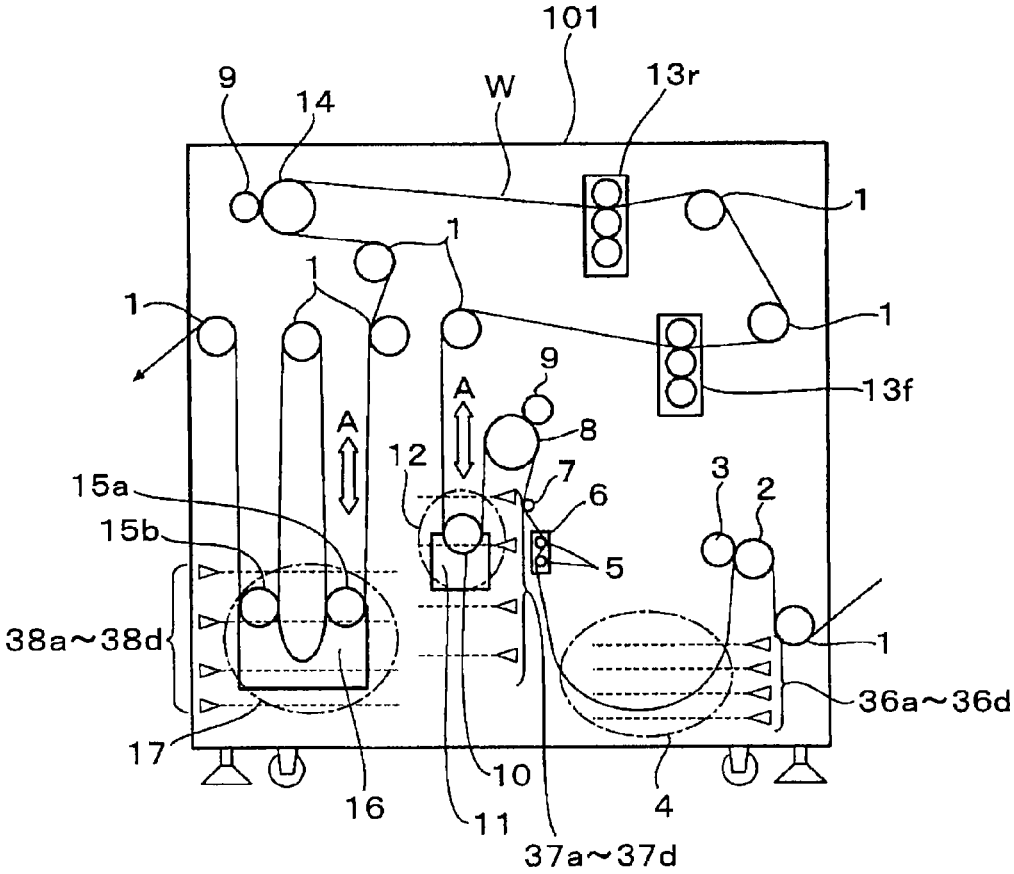
FIG. 8 Prior Art
FIG. 8 is a schematic configuration diagram of one example of a treatment agent applying apparatus used in this image forming system.

Next, drawings are used to explain embodiments of the present invention. A flow of an inkjet image forming system according to embodiments of the present invention is the same as in FIG. 7. Moreover, a schematic configuration of a treatment agent applying apparatus for use in the image forming system is the same as in FIG. 8, so that repetitious explanations are omitted.

Figure 1A:
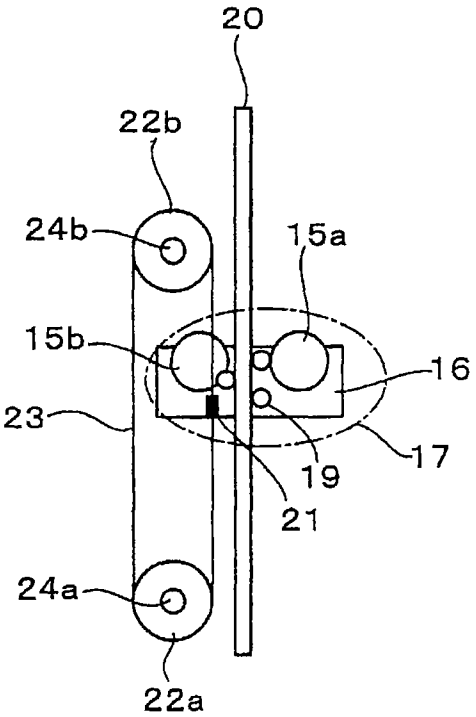
FIG. 1A is a schematic configuration diagram as viewed from a front face of a dancer roller apparatus according to a first embodiment of the present invention.
Figure 1B:
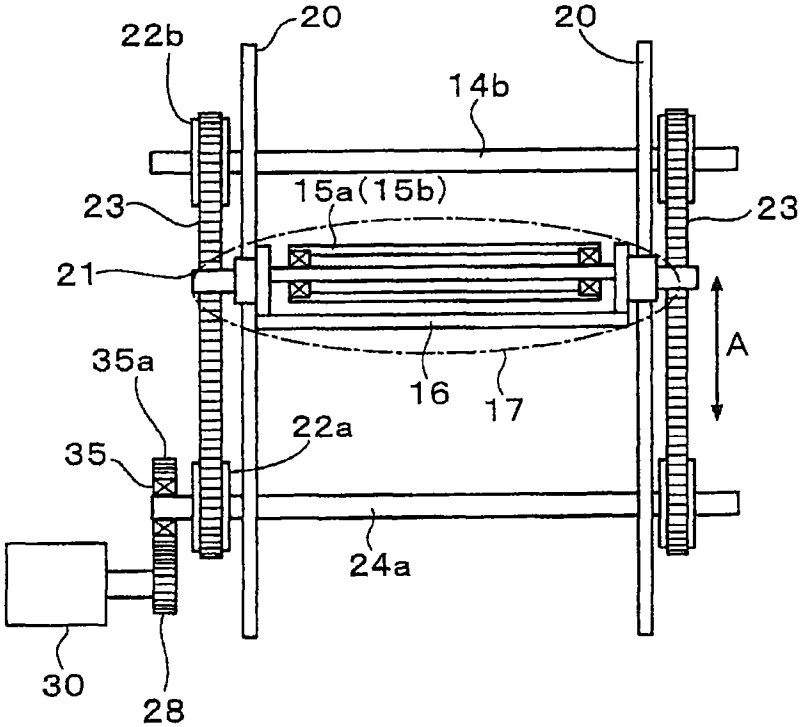
FIG. 1B is a schematic configuration diagram as viewed from a side face for explaining a drive system of the dancer roller apparatus according to the first embodiment of the present invention.

FIGS. 1A, 1B, and 2 are diagrams for explaining the first embodiment of the present invention, where FIG. 1A is a schematic configuration diagram as viewed from a front face of the dancer roller apparatus used in the treatment agent applying apparatus and FIG. 1B is a schematic configuration as viewed from a side face thereof for explaining a drive system of the dancer roller apparatus.

As shown in FIGS. 1A and 1B, two rail shafts 20 are arranged with a predetermined gap along gravity directions (upward and downward directions) A, between which two rail shafts 20 a dancer roller mechanism 17 is arranged. As shown in FIG. 1A, on the side face of a movable frame 16 are fixed multiple (three in this example) shaft guides 19, among which the rail shafts 20 are placed.

Moreover, the movable frame 16 is connected to timing belts 23 by belt clampers 21. The timing belts 23 are stretched between corresponding sets of timing pulleys 22*a* and 22*b*, while phases of the timing pulleys 22*a* and 22*b* are fixed with keys (not shown), etc., to the respective ends of elevating axles 24*a* and 24*b*.

A drive transmission gear 35*a* which is fixed by press fitting, etc., with a one way clutch 35 inside is installed at one end of the elevating axle 24*a*. This drive transmission gear 35*a* is engaged with a drive gear 28 which is installed at the drive axle of a motor 30 which can rotate forward and backward.

Figure 2A:
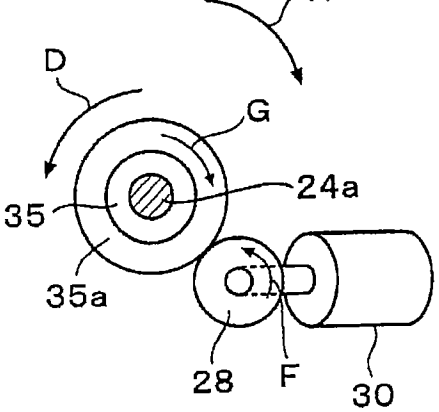
FIG. 2A is a diagram illustrating a rotating direction of each member from a motor to an elevating axle during web conveying for a movement of the dancer roller mechanism of the dancer roller apparatus.
Figure 2B:
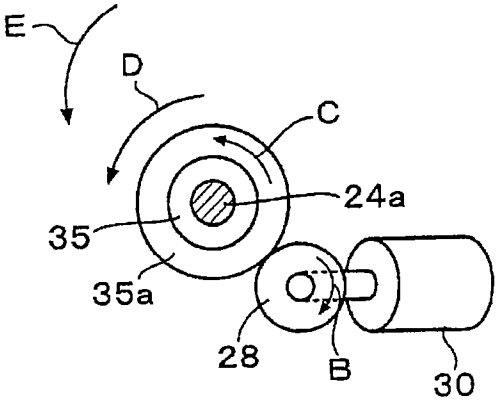
FIG. 2B is a diagram illustrating the rotating direction of each member from the motor to the elevating axle when the dancer roller mechanism is raised at the time of web loading for the movement of the dancer roller mechanism of the dancer roller apparatus.
Figure 2C:
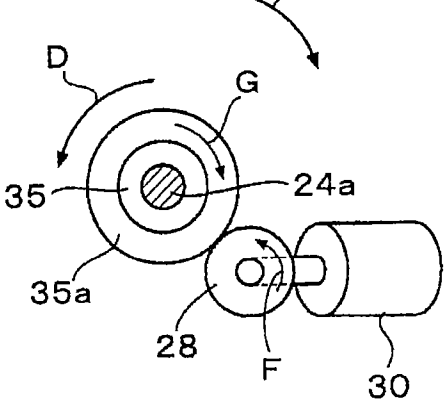
FIG. 2C is a diagram illustrating the rotating direction of each member from the motor to the elevating axle when the dancer roller mechanism is lowered for the movement of the dancer roller mechanism of the dancer roller apparatus.

FIGS. 2A to 2C are diagrams for explaining a rotating direction of each member from the motor 30 to the elevating axle 24*a* in a case of a movement of the dancer roller mechanism 17, where FIG. 2A is a diagram showing a rotating direction of each member during web conveying; FIG. 2B is a diagram showing a rotating direction of each member when the dancer roller mechanism 17 is raised at the time of loading the web W; and FIG. 2C is a diagram showing a rotating direction of each member when the dancer roller mechanism 17 is lowered.

A direction for allowing the one way clutch 35 to rotate is set to be a direction in which a slack of the web W occurs (a direction in which the dancer roller mechanism 17 is raised) due to an operation of the dancer roller mechanism 17 when the drive transmission gear 35*a* does not rotate. In other words, when the drive transmission gear 35*a* does not rotate, the dancer roller mechanism 17 may move in a direction in which the slack occurs (a direction in which the dancer roller mechanism 17 is raised), but may not move in a web pull tension direction (a direction in which the dancer roller mechanism 17 is lowered).

Figure 9:
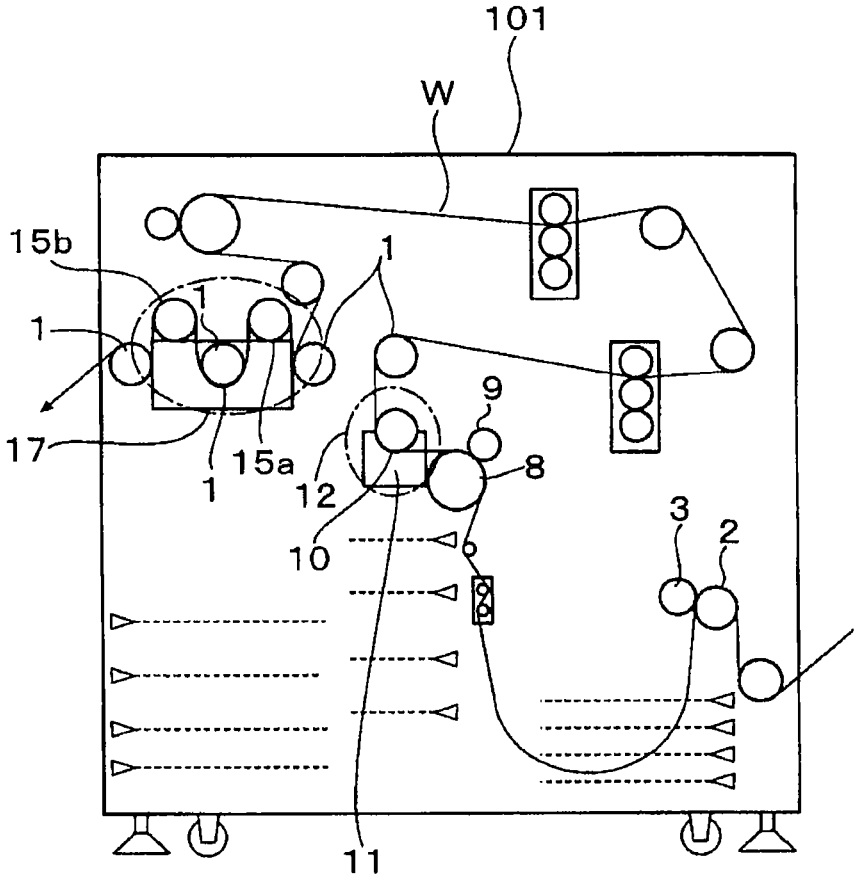
FIG. 9 Prior Art
FIG. 9 is an overview configuration diagram showing a state in which a related-art first dancer roller mechanism and a second dancer roller mechanism are raised at the time of web loading.
Figure 10A:
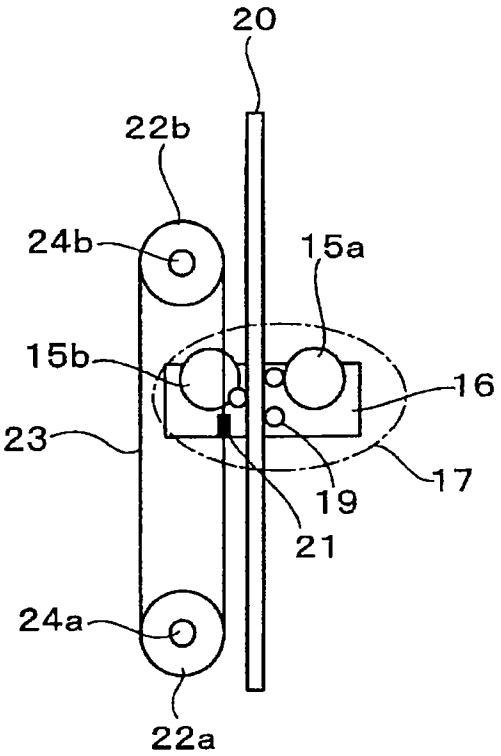
FIG. 10A Prior Art
FIG. 10A is a schematic configuration diagram as viewed from a front face that is for explaining a schematic configuration of the dancer roller apparatus.
Figure 10B:
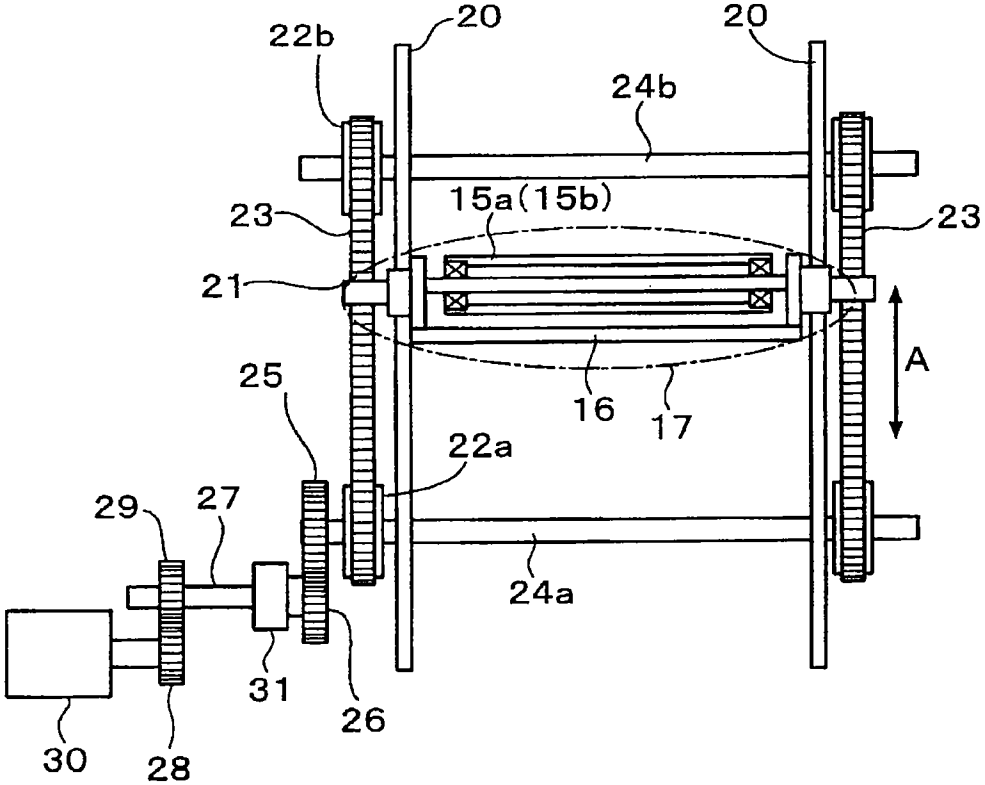
FIG. 10B Prior Art
FIG. 10B is a schematic configuration diagram as viewed from a side face that is for explaining a drive system of the dancer roller apparatus for explaining a schematic configuration of the dancer roller apparatus.
Figure 11:
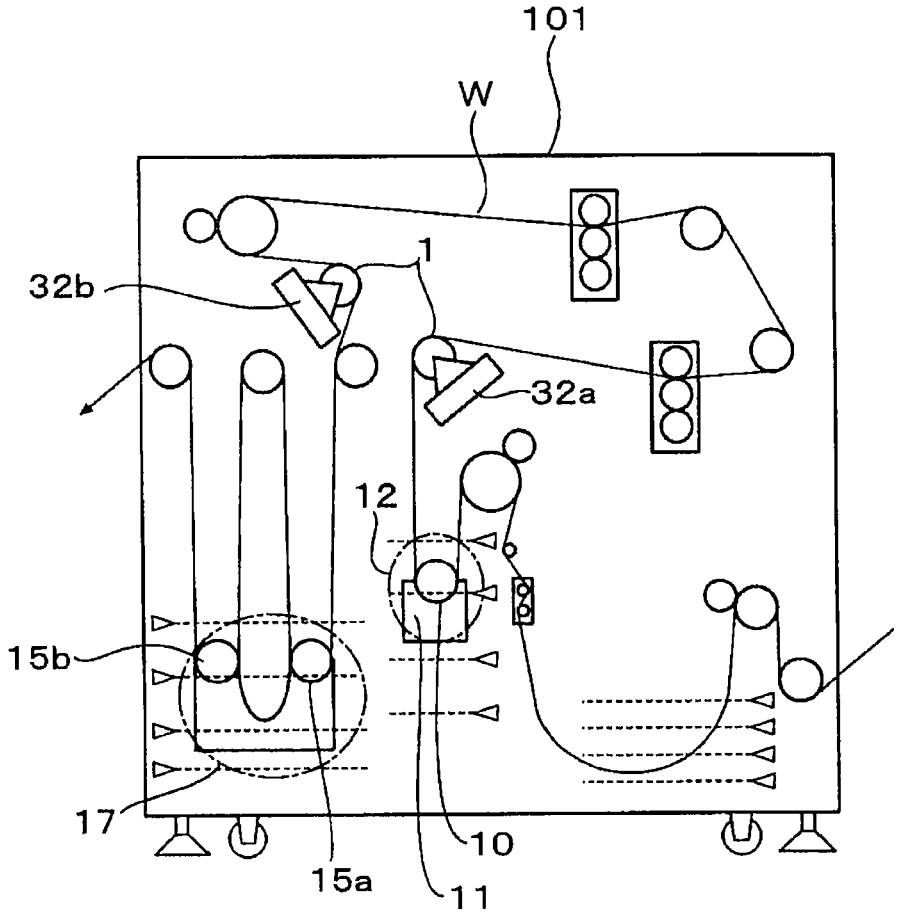
FIG. 11 Prior Art
FIG. 11 is a schematic configuration diagram of a treatment agent applying apparatus in which a web tension detecting unit is arranged on the web conveying path.
Figure 12:
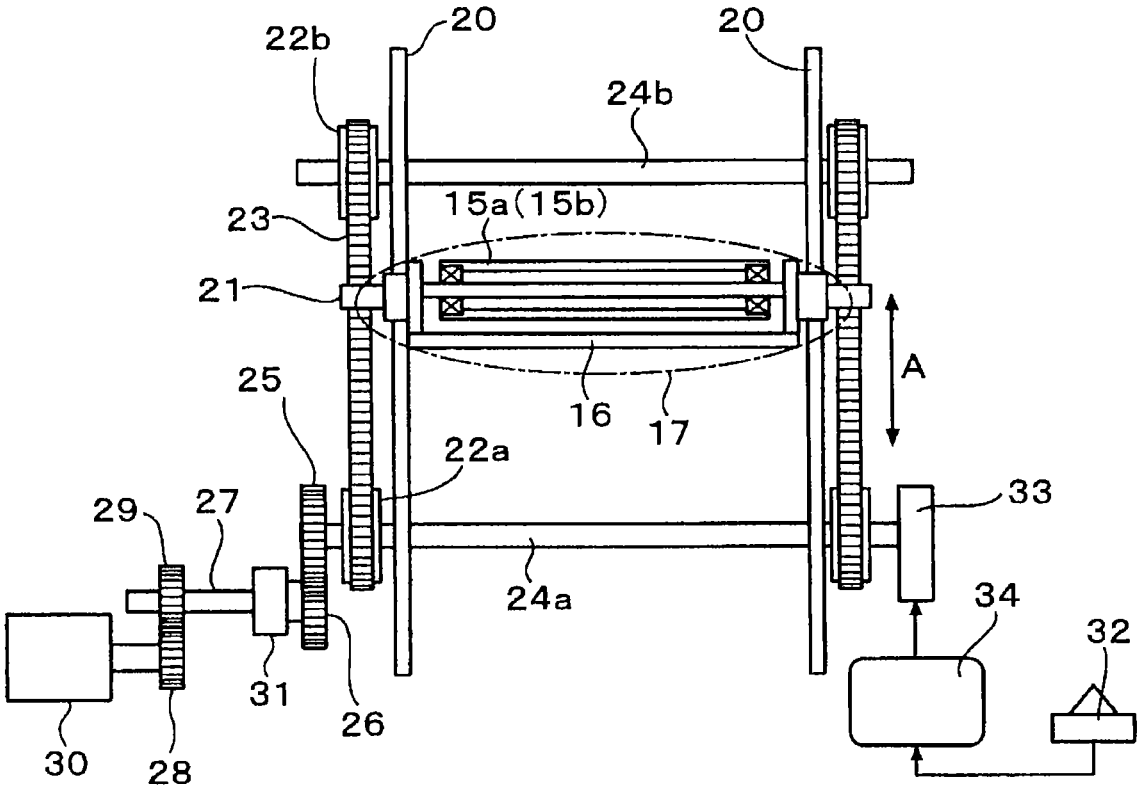
FIG. 12 Prior Art
FIG. 12 is a schematic configuration diagram as viewed from a side face of the drive system of the dancer roller apparatus which is used in the treatment agent applying apparatus.

At the time of loading the web W, it is necessary to raise the dancer roller mechanism 17 as shown in FIG. 9 to shorten a length of a path which continues with the guide roller 1 to improve operability of web loading.

Here, in order to raise the dancer roller mechanism 17, as shown in FIG. 2B, when the motor 30 (the drive gear 28) is rotationally driven in a clockwise B direction, the drive transmission gear 35*a*, which is engaged with the drive gear 28, rotates in a counterclockwise C direction. An arrow D direction, which shows a lock direction of the one way clutch 35, is a direction in which a housing locks when an axle is fixed, or a direction is which axle rotating is allowed when the housing is fixed.

As described above, when the drive transmission gear 35*a* rotates in a counterclockwise C direction, the one way clutch 35 is in a lock state, so that rotational drive is transmitted to the elevating axle 24*a* via the one way clutch 35 and the elevating axle 24*a* rotates in an arrow E direction.

When the elevating axle 24*a* rotates in an arrow E direction, the dancer roller mechanism 17 is raised via the timing pulleys 22*a*, 22*b*, and the timing belts 23, causing the slack of the web W to occur, making it possible to shorten a path length of the web W.

In FIG. 2C, which shows a case in which the dancer roller mechanism 17 is lowered, when the motor 30 (the drive gear 28) is rotationally driven in a counterclockwise F direction which is reverse that in FIG. 2B, the drive transmission gear 35*a*, which is engaged with the drive gear 28, rotates in the clockwise direction G and the one way clutch 35 also rotates in the same clockwise G direction.

This clockwise G direction is not the above-described D direction in which the one way clutch 35 is locked, so that the elevating axle 24*a* does not rotate in a forced manner. Here, there is a running torque applied also on the elevating axle 24 due to a weight of the dancer roller mechanism 17, so that, as a result, the elevating axle 24*a* also rotates in an arrow H direction with rotating of the drive transmission gear 35*a* and the dancer roller mechanism 17 is lowered.

In this way, in order to switch a path length of the web W such as at the time of web loading, an operation of raising or lowering the dancer roller mechanism 17 is possible.

Next, functions of the dancer roller mechanism 17 at the time of web conveying are described using FIG. 2A.

As described above, during the web conveying, the dancer roller mechanism 17 is hung by the web W. Thus, the dancer roller mechanism 17 has to move upward and downward in accordance with a change in a web length that changes due to a difference in web conveying speeds between an out feed roller 14 (see FIG. 8) which is positioned on the upstream side of the web conveying direction of the dancer roller mechanism 17 and a conveying roller (not shown) which determines a web sending in speed within the inkjet printer 102 (see FIG. 7) which is positioned on the downstream of the web conveying direction.

Here, when the web length becomes short, or, in other words, when it is necessary for the dancer roller mechanism 17 to be raised, the one way clutch 35 is not in a lock direction, so that the dancer roller mechanism 17 can undergo a raising operation, hung by the web W.

Moreover, conversely, when the web length becomes long, or, in other words, when it is necessary for the dancer roller mechanism 17 to be lowered, the one way clutch 35 is in a lock direction, so that, in this state, the dancer roller mechanism 17 is not lowered, resulting in a slack to occur in the web W, making it not possible to provide tension to the web, which is a different function of the dancer roller mechanism 17.

Thus, in the present invention, the one way clutch 35 is caused to rotate in a direction in which the dancer roller mechanism 17 moves in a web stretching direction. In a configuration in FIG. 2A, the motor 30 (the drive gear 28) is rotationally driven in the same counterclockwise F direction as in FIG. 2C (a direction in which the dancer roller mechanism 17 is to be lowered) and the one way clutch 35 and the drive transmission gear 35*a* engage with the drive gear 28 in the clockwise direction G.

In this way, due to a difference in rotational speed between the elevating axle 24*a* and the one way clutch 35, when the one way clutch 35 is set to be a reference, it is possible to create a state in which the elevating axle 24*a* is relatively rotating in a direction which is not the lock direction, making it possible for the dancer roller mechanism 17 to be lowered by following a change of the web length and to continue providing tension to the web W.

Then, when the web breaks during the web conveying, the timing pulleys 22*a*, 22*b*, and the timing belt 23 operate in accordance with what is to be a rotational speed of the drive transmission gear 35*a*, the one way clutch 35, and the elevating axle 24*a* that are rotationally driven by the motor 30, so that the dancer roller mechanism 17 is to be lowered at a specified speed. Therefore, an impact of a collision due to a related-art free fall of the dancer roller mechanism 17 does not occur, making it possible to prevent breaking, etc., of the dancer roller mechanism 17. Moreover, a configuration becomes simple relative to a configuration of the related art dancer roller mechanism, so that it is highly reliable and inexpensive.

While a configuration in which the one way clutch 35 is provided in the drive transmission gear 35*a* is explained as one example, it goes without saying that the same advantage is obtained as long as the one way clutch 35 is within the drive transmission system of the dancer roller mechanism 17 and the motor, so that it may be arranged between an axle of the motor 30 and the drive gear 28, or between the timing pulley 22*a* and the elevating axle 24*a*.

Moreover, while drive transmission from the motor 30 to the elevating axle 24*a* is performed by the gears in FIGS. 1 and 2, it may be arranged for the drive transmission system to be a timing pulley and a timing belt, and for the timing pulley to be provided with the one way clutch.

Figure 3:
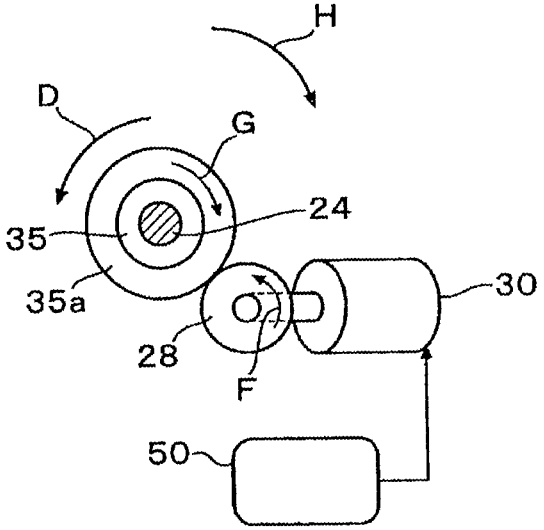
FIG. 3 is a partial schematic configuration diagram of the dancer roller apparatus according to a second embodiment of the present invention.

FIG. 3 is a partial schematic configuration diagram of the dancer roller apparatus according to a second embodiment of the present invention. In this embodiment, a setting input unit 50 for setting a rotational drive speed of the motor 30 within the web conveying is provided, and the setting input unit 50 is connected to the motor 30.

In the first embodiment, while the dancer roller mechanism 17 can be moved in raising and lowering directions in accordance with a change of the web length, there is a constraint due to a lock function of the one way clutch 35 only for the lowering direction. In other words, it is not possible for the rotational speed of the elevating axle 24*a* to exceed the rotational speed of the one way clutch 35.

When the rotational speed of the elevating axle 24*a* in accordance with the lowering operation of the dancer roller mechanism 17 is about to exceed the rotational speed of the one way clutch 35, it is not possible to perform the lowering operation of the dancer roller mechanism 17 at a speed which is greater or equal to a speed in accordance with the rotational speed of the one way clutch 35 due to a lock function of the one way clutch 35, thus causing a slack to occur in the web W, making it not possible to provide tension to the web W, which is a different function of the dancer roller mechanism 17.

In the present embodiment, in order to avoid this, a rotational drive speed of the motor 30 is input and determined by the setting input unit 50, so that there is no functional problem. For example, when a web conveying speed of a conveying roller (not shown) which determines a web sending in speed within the inkjet printer 102 that is to be a reference is 120 m/min (=2 m/s) and a web conveying speed of the out feed roller 14 (see FIG. 8) for performing position control of the dancer roller mechanism 17 is controlled to be between 114 m/min (=1.9 m/s) and 126 m/min (=2.1 m/s), the lowering speed of the dancer roller mechanism 17 becomes, at a maximum, a speed in accordance with a changing speed of the web length that is 0.1 m/s=100 mm/s at a maximum.

When the dancer roller mechanism 17, as in accordance with the present embodiment, is wound in a W shape and hung by four webs W, a lowering speed of the dancer roller mechanism 17 becomes one fourth a changing speed of the web length, so that it becomes 25 mm/s at a maximum. In other words, when the motor 30 is caused to rotate at a speed which may lower the dancer roller mechanism 17 at a speed such that the lowering speed of the dancer roller mechanism 17 exceeds 25 mm/s, or, 30 mm/s by nature, the above-described problems may be avoided. When a diameter of the timing pulley 22*a* is around 36 mm and a reduction gear ratio is around 40, it may be rotationally driven around $$30\ \text{mm/s} \div (36\ \text{mm} \times \pi) \times 40 \approx 10.6\ \text{rps}\ (\approx 640\ \text{rps}).$$

In this way, an operation becomes possible without any constraints within a range of actual use even for movement to a lowering direction of the dancer roller mechanism 17, making it possible to provide a dancer roller mechanism which has no functional problem.

For example, when jamming occurs inside the treatment agent applying apparatus 101 as a function of the dancer roller mechanism 17, it is necessary to secure a buffer amount which allows a downstream inkjet printer 102 to stop safely. When the web conveying speed is reduced from 120 m/min (=2 m/s) to 1 m/s^2, a buffer amount of 2 m, or $$2\ \text{m/s} \times (2\ \text{m/s} \div 1\ \text{m/s}^2) \div 2 = 2\ \text{m becomes necessary.}$$

For having a web buffer of 2 m (2000 mm), a moving range of at least 500 mm is necessary with the dancer roller mechanism 17 which is wound in a W shape, or, in other words, a free fall of at least 500 mm could occur with the related-art dancer roller mechanism. For the free fall of 500 mm, the falling speed exceeds 3000 mm/s. Moreover, even for the free fall of 1 mm, the falling speed is approximately 140 mm/s, so that 30 mm/s is a sufficiently small value.

Therefore, an impact with which the dancer roller mechanism 17 collides onto an apparatus floor face may be ignored from a practical point of view. Here, the idea is similar for the related art first dancer roller mechanism 12 within the treatment agent applying apparatus 101, where values to be used are the web conveying speed of the out feed roller 14 and the web conveying speed of the in feed roller 8 and the dancer roller mechanism 12 is hung by two webs, so that a lowering speed of the dancer roller mechanism 12 becomes one half the changing speed of the web length. While a value used in calculating differs depending on a path shape of the web W or a configuration of the dancer roller, it goes without saying that the idea is similar. A required rotational speed of the motor 30 may be calculated from each design specification to set and input the calculated results.

As a different embodiment, a rotational speed of the motor 30 is determined in accordance with the web conveying speed of the out feed roller 14 on the upstream side in the web conveying direction of the dancer roller mechanism 17 and the web conveying speed of the conveying roller (not shown) which determines a web sending in speed within the inkjet printer 102 on the downstream side in the web conveying direction of the dancer roller mechanism 17.

In other words, the web conveying speed of the out feed roller 14 and the web conveying speed of the conveying roller (not shown) which determines the web sending in speed within the inkjet printer 102 are monitored and operated to calculate a moving speed of the dancer roller mechanism 17 in accordance with a change of the web length, and an operation similar to what is described above is performed, estimating a margin of 120% for the above-described calculated moving speed of the dancer roller mechanism 17, for example, such that the rotational speed of the elevating axle 24*a* at the time the dancer roller mechanism 17 is lowered does not exceed the rotational speed of the one way clutch 35, so that the computed value is set to be a rotational drive speed of the motor 30.

In this way, even when a control range of the web conveying speed of the out feed roller 14 for performing position control of the dancer roller mechanism 17 is changed, it is not necessary to change the rotational drive speed of the motor 30 at any time, making it possible to provide a highly versatile dancer roller mechanism.

Here, for a unit which detects the web conveying speed of the out feed roller 14 and the web conveying speed of the conveying roller which determines the web sending in speed within the inkjet printer 102, various schemes are possible such as a scheme in which a Doppler velocimeter, etc., is applied onto a web face at each area to perform a detection directly, or an indirect scheme in which a rotational speed of each roller is detected by an encoder to perform an operation from a diameter of each roller. However, what kind of unit is used is not relevant to the gist of the present invention.

Figure 4:
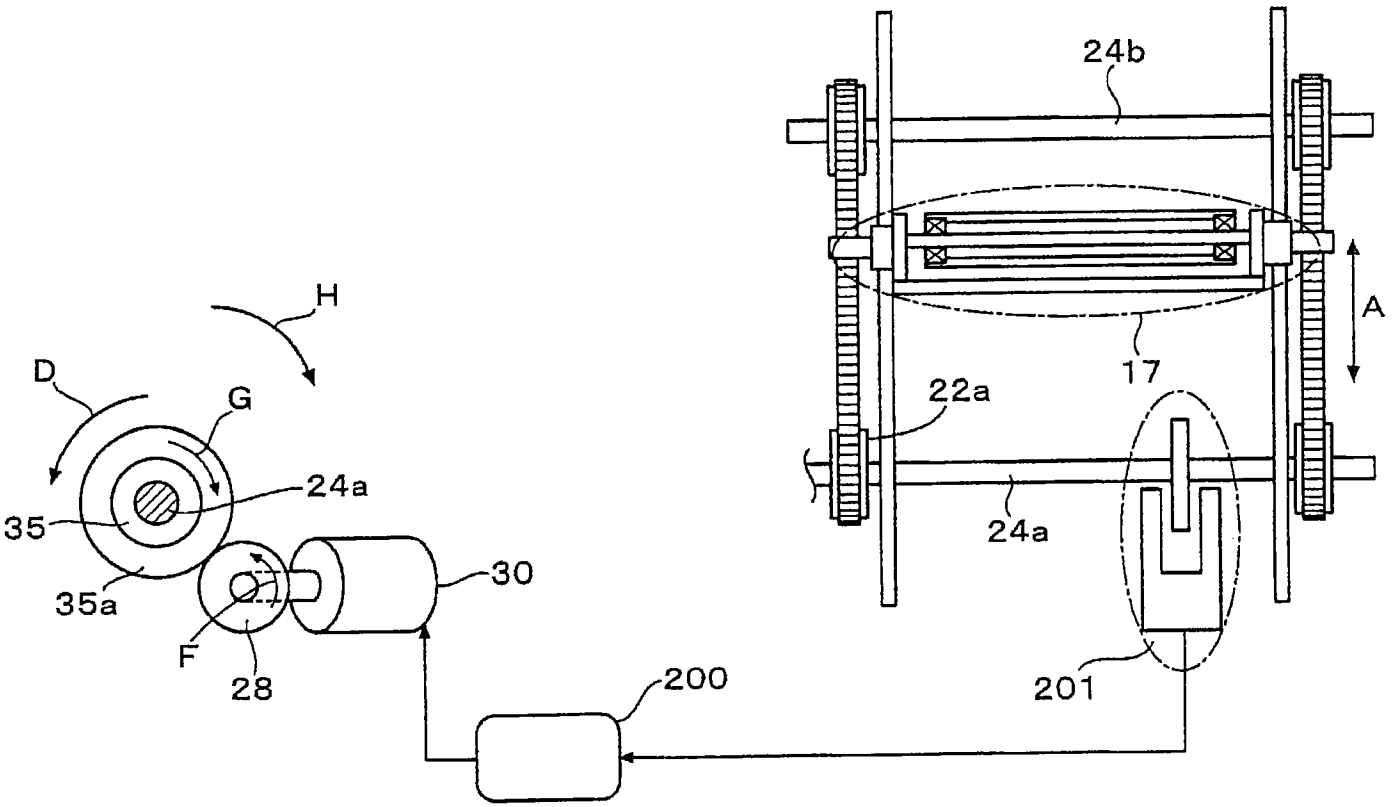
FIG. 4 is a schematic configuration diagram of the dancer roller apparatus according to a third embodiment of the present invention.

FIG. 4 is a schematic configuration diagram of the dancer roller apparatus according to a third embodiment.

In the present embodiment as shown in FIG. 4, a dancer roller moving speed detecting unit 201 which detects a moving speed of the dancer roller mechanism 17 and a motor drive speed control unit 200 which determines and controls a rotational speed of the motor 30 based on a detection signal from the dancer roller moving speed detecting unit 201 are provided.

In the present embodiment, while an example of using a rotational encoder which is mounted to the elevating axle 24*a* and a detector which optically detects a rotational amount of the rotational encoder is shown as the dancer roller moving speed detecting unit 201, regardless of what scheme carried out in the related art is used, the scheme which detects the moving speed of the dancer roller mechanism 17 is not relevant to the gist of the present invention.

An operation similar to what is described above in performed based on information of the dancer roller moving speed detecting unit 201 and a rotational speed of the motor 30 is determined and controlled by the motor drive speed control unit 200.

In this way, an error, etc., due to slipping of the web W is reduced relative to the scheme of detecting the rotational speed of each conveying roller in the upstream and in the downstream, making it possible to more accurately detect a moving speed of the dancer roller mechanism 17. Therefore, a margin is decreased of the rotational speed of the motor 30 such that the rotational speed of the elevating axle 24*a* does not exceed the rotational speed of the one way clutch 35 to suppress the rotational speed to a required minimum, thereby making it possible to reduce a drive current of the motor 30 and making it possible to reduce abrasion of a gear, etc., which rotate in the configuration.

Moreover, as a different embodiment, it is detected that a moving direction of the above-described dancer roller mechanism 17 is a raising direction (a direction which allows rotating of the one way clutch 35), or, when a calculation is performed with an operation, a rotation of the motor 30 is stopped. In a general positional control of the dancer roller mechanism 17, a time of moving toward a raising direction and a time of moving toward a lowering direction relative to a specified position are generally equivalent. As rotation of the one way clutch 35 is allowed when the moving direction of the dancer roller mechanism 17 is a raising direction, there is no functional problem even when the motor 30 is not driven, so that rotation of the motor 30 is required at a rotational speed with no problem for an actual use only when a moving direction of the dancer roller mechanism 17 is a lowering direction.

Therefore, with such an operation, a time of rotating the motor 30 becomes generally half the total web conveying time, making it possible to suppress to a minimum abrasion of a gear, etc., which rotates in the configuration and the drive current.

Moreover, in a different embodiment, in a configuration in which a dancer roller moving speed detecting unit 201 which detects a moving speed of the dancer roller mechanism 17 is provided as shown in FIG. 4, wherein, when a thereby detected or computed moving speed of the dancer roller mechanism 17 in a lowering direction reaches an original moving speed of the dancer roller mechanism 17 in the lowering direction in accordance with a rotational speed of the motor 30, an error signal is emitted.

This state occurs when the web W breaks, or when a difference between the web conveying speed on the upstream side and the web conveying speed on the downstream side of the dancer roller mechanism 17 becomes larger than anticipated, so that, as a result, the lowering speed of the dancer roller mechanism 17 cannot catch up with the changing speed of the web length and a slack occurs in the web W of the part. Therefore, an error may be issued to prevent the apparatus from continuing web conveying when the web breaks and to prevent a provision of works with degraded printing image quality which occurs as a result from the slack occurring in the web W.

Figure 5:
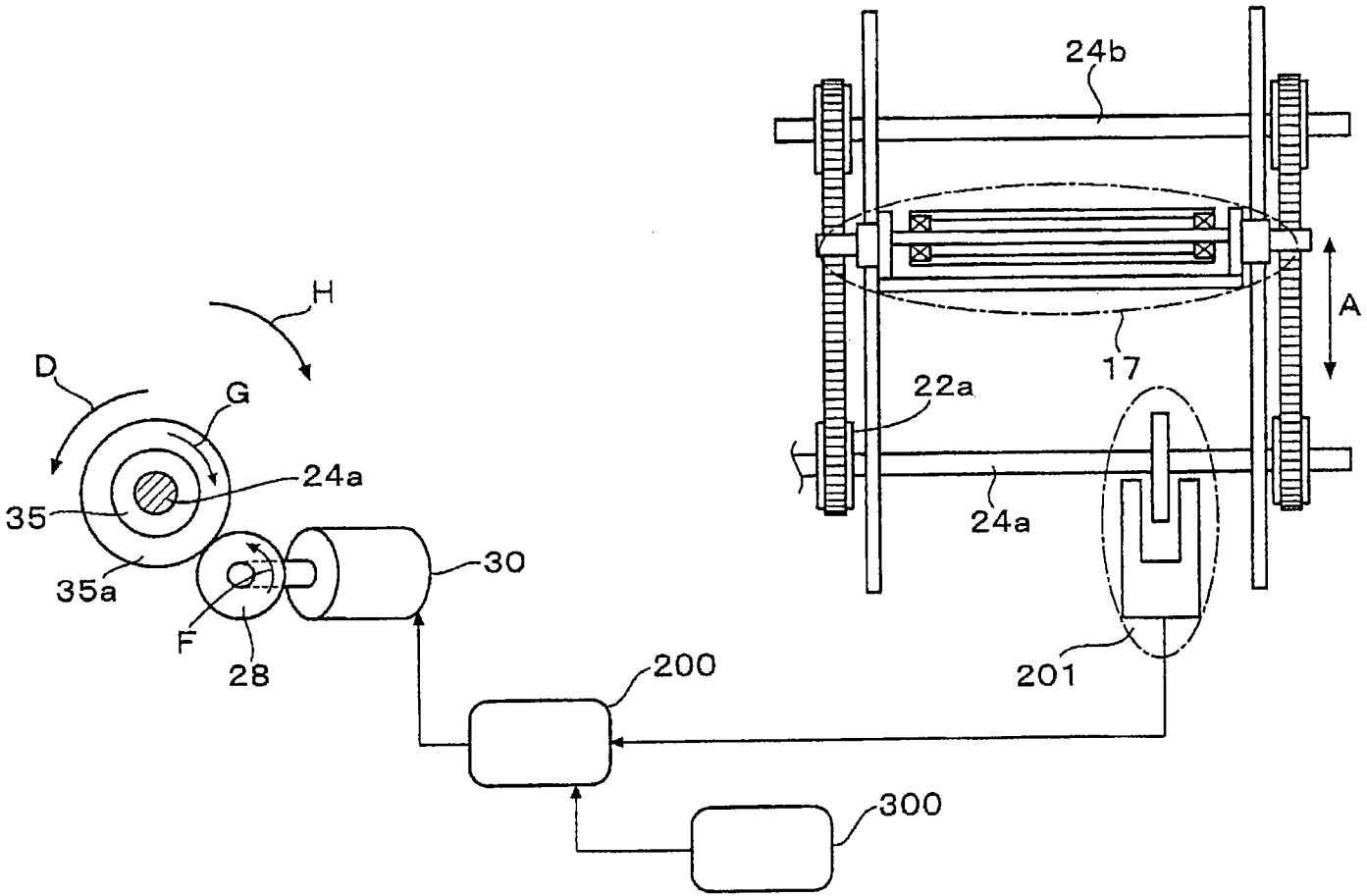
FIG. 5 is a schematic configuration diagram of the dancer roller apparatus according to a fourth embodiment of the present invention.

FIG. 5 is a schematic configuration diagram of the dancer roller apparatus according to a fourth embodiment. In this embodiment is provided an upper limit speed setting input unit 300 which sets and inputs an upper limit speed of the motor 30, which upper limit speed setting input unit 300 is connected to the motor drive speed control unit 200.

In the previously-described embodiments, a rotational driving speed of the motor 30 is determined such that the rotational speed of the elevating axle 24*a* in accordance with a moving direction in a lowering direction of the dancer roller mechanism 17 does not exceed the rotational speed of the one way clutch 35. The dancer roller mechanism 17 is lowered in accordance with a rotational speed of the motor 30 when the web W breaks during web conveying.

While it is a matter of course that the lowering speed is a speed which does not cause breakage when the dancer roller mechanism 17 collides onto an apparatus floor face, various speeds to be an upper limit are possible depending on conditions to be taken into account, such as a speed with which a sound of collision may be allowed, or a speed with which a service life of the motor 30 itself may be secured, for example.

Therefore, as in this embodiment, the upper limit speed setting and inputting unit 300 may be provided and connected to the motor drive speed control unit 200 to set an upper limit of the rotational speed of the motor 30 to an optimal value in that condition even in various conditions as described above.

Figure 6A:
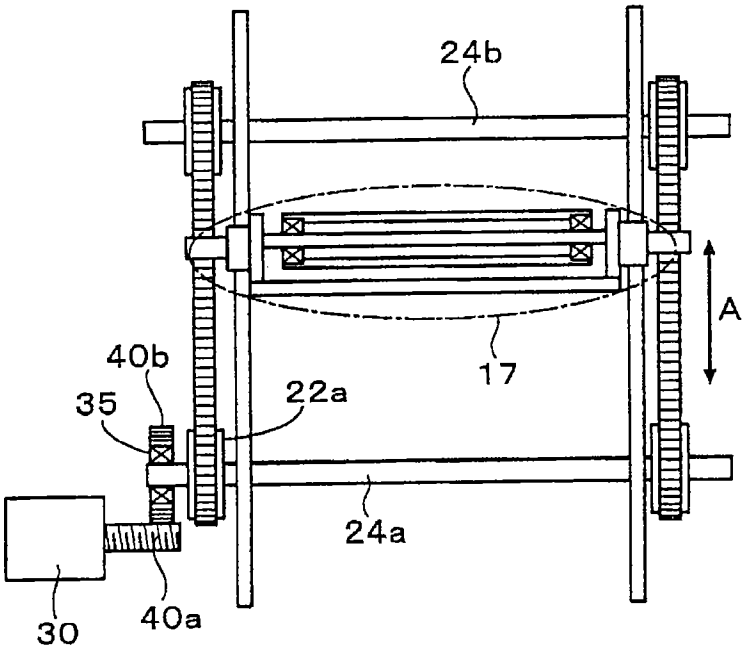
FIG. 6A is a schematic configuration diagram as viewed from a front face of a dancer roller apparatus according to a fifth embodiment of the present invention.
Figure 6B:
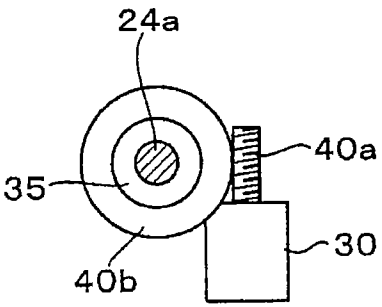
FIG. 6B is a schematic configuration diagram as viewed from a side face of the dancer roller apparatus for explaining a drive system according to the fifth embodiment of the present invention.

FIG. 6A is a schematic configuration diagram as viewed from a front face of a dancer roller apparatus according to the fifth embodiment, and FIG. 6B is a schematic configuration diagram as viewed from a side face for describing a drive system of the dancer roller apparatus.

In this embodiment, a worm gear 40 is used as a drive transmission unit which transmits a drive power of the motor 30. As shown in FIGS. 6A and 6B, this worm gear 40 includes a worm 40*a* which is provided on the rotational axle side of the motor 30 and a worm wheel 40*b* which is provided on the one way clutch 35 side.

As it is not possible to cause it to rotate from the worm wheel 40*b* side due to a self stopping property of the worm gear 40, the elevating axle 24*a* does not rotate even when the motor 30 does not have a stop torque, and, thus, the dancer roller mechanism 17 does not fall. Such a configuration makes it possible to prevent a fall of the dancer roller mechanism 17 even when a web breaks during web conveying and magnetic excitement to the motor 30 is stopped.

While a configuration is described in the present embodiment of hanging a dancer roller mechanism 17 with a web W and providing tension to the web W with a self weight of the dancer roller mechanism 17, a problem in which the dancer roller mechanism collides onto a stopper, etc., due to a spring force is similar to when the web breaks even for a dancer roller mechanism with a configuration in which, for example, a dancer roller moves in a horizontal direction, wherein the dancer roller is pulled with a spring force to provide tension to the web, or a dancer roller mechanism with a configuration in which a dancer roller is supported to a tip of an oscillating lever, which is pulled to a web tension increasing direction due to a spring force, making it possible with a configuration of the present invention to prevent the dancer roller mechanism form colliding with a stopper, etc.

While a case of using a web which is continuous as a long object is described in the above-described embodiments, the present invention is also applicable to a dancer roller apparatus which handles other long-shaped objects such as cloth, synthetic resin film, a string shaped object, etc.

The present application is based on Japanese Priority Application No. 2012-097800 filed on Apr. 23, 2012, the entire contents of which are hereby incorporated by reference.

The invention claimed is:

1. A dancer roller apparatus, comprising:

a dancer roller which is arranged with a gap on a conveying path of a long object to convey the long object and is provided between a downstream side conveying unit and an upstream side conveying unit to absorb an amount of slack of the long object between the upstream side conveying unit and the downstream side conveying unit and provide tension to the long object;

a drive motor for changing a position of the dancer roller during conveying of the long object and at a time of loading to switch a path length of the long object, the drive motor including a drive axle; and a dancer roller position changing unit which includes a drive transmission gear that is installed at one end of an elevating axle, the drive transmission gear being engaged with a drive gear which is installed at the drive axle of the drive motor which can rotate forward and backward, the dancer roller position changing unit configured to transmit a driving force from the drive motor to change the position of the dancer roller, wherein the dancer roller position changing unit further includes a one way clutch which allows the dancer roller to move in a long object slack direction, and wherein the drive motor is caused to rotate in a direction such that the dancer roller moves the one way clutch in a long object stretching direction during the conveying of the long object.

2. The dancer roller apparatus as claimed in claim 1, further comprising a speed setting and inputting unit for setting a rotational speed of the drive motor.

3. The dancer roller apparatus as claimed in claim 2, wherein the speed setting and input unit is configured to calculate a position moving speed of the dancer roller based on a difference in a long object conveying speed of the upstream side conveying unit and the downstream side conveying unit during the long object conveying to determine a rotational speed of the drive motor in accordance with the calculated position moving speed.

4. The dancer roller apparatus as claimed in claim 3, wherein the dancer roller apparatus is configured to stop rotating of the driving motor when a moving direction of the dancer roller is a slack direction of the long object.

5. The dancer roller apparatus as claimed in claim 3, further comprising a rotational speed upper limit value setting and inputting unit which sets and inputs an upper limit value of the drive motor rotational speed.

6. The dancer roller apparatus as claimed in claim 2, further comprising a dancer roller moving speed detecting unit which detects a moving speed of the dancer roller, wherein the dancer roller apparatus is configured to set the rotational speed of the drive motor with the speed setting and inputting unit based on a detected value from the dancer roller moving speed detecting unit.

7. The dancer roller apparatus as claimed in claim 1, wherein the dancer roller apparatus is configured to determine that there is an error when a moving speed of the dancer roller in the stretching direction of the long object approaches an original moving speed of the dancer roller in dependence on a rotational speed of the drive motor.

8. The dancer roller apparatus as claimed in claim 1, wherein a worm gear is used as a driving force transmission unit of the dancer roller position changing unit.

* * * * *